US006670921B2

(12) United States Patent
Sievenpiper et al.

(10) Patent No.: US 6,670,921 B2
(45) Date of Patent: Dec. 30, 2003

(54) LOW-COST HDMI-D PACKAGING TECHNIQUE FOR INTEGRATING AN EFFICIENT RECONFIGURABLE ANTENNA ARRAY WITH RF MEMS SWITCHES AND A HIGH IMPEDANCE SURFACE

(75) Inventors: Daniel F. Sievenpiper, Los Angeles, CA (US); Adele E. Schmitz, Newbury Park, CA (US); James H. Schaffner, Chatsworth, CA (US); Gregory L. Tangonan, Oxnard, CA (US); Tsung-Yuan Hsu, Westlake Village, CA (US); Robert Y. Loo, Agoura Hills, CA (US); Robert S. Miles, Monrovia, CA (US)

(73) Assignees: HRL Laboratories, LLC, Malibu, CA (US); Raytheon Company, Lexington, MA (US)

( * ) Notice: Subject to any disclaimer, the term of this patent is extended or adjusted under 35 U.S.C. 154(b) by 0 days.

(21) Appl. No.: 09/906,035

(22) Filed: Jul. 13, 2001

(65) Prior Publication Data

US 2003/0011518 A1 Jan. 16, 2003

(Under 37 CFR 1.47)

(51) Int. Cl.[7] ..... H01Q 1/38; H01Q 15/02

(52) U.S. Cl. ..... 343/700 MS; 343/754; 343/909

(58) Field of Search ..... 343/700 MS, 753, 343/754, 909, 910, 911, 833, 834, 795

(56) References Cited

U.S. PATENT DOCUMENTS

| | | | | |
|---|---|---|---|---|
| 3,267,480 A | 8/1966 | Lerner | ..... | 343/911 |
| 3,810,183 A | 5/1974 | Krutsinger et al. | ..... | 343/708 |
| 3,961,333 A | 6/1976 | Purinton | ..... | 343/872 |
| 4,150,382 A | 4/1979 | King | ..... | 343/754 |

(List continued on next page.)

FOREIGN PATENT DOCUMENTS

| | | | | |
|---|---|---|---|---|
| DE | 196 00 609 A1 | 4/1997 | ..... | H01P/1/165 |
| EP | 0 539 297 | 4/1993 | ..... | H01Q/17/00 |
| EP | 0 801 423 A2 | 10/1997 | ..... | H01L/21/68 |
| FR | 2 785 476 | 5/2000 | ..... | H04B/7/02 |
| GB | 2 281 662 | 3/1995 | ..... | H01Q/13/08 |
| GB | 2 328 748 | 3/1999 | ..... | G01S/13/93 |
| WO | 94/00891 | 1/1994 | ..... | H01Q/15/00 |
| WO | 96/29621 | 9/1996 | ..... | G02B/5/20 |
| WO | 98/21734 | 5/1998 | ..... | H01H/59/00 |
| WO | 99/50929 | 10/1999 | ..... | H01Q/1/38 |
| WO | 00/44012 | 7/2000 | ..... | H01H/1/00 |
| WO | 01/31664 A1 | 5/2001 | ..... | H01H/1/00 |

OTHER PUBLICATIONS

Balanis, C., "Aperture Antennas," *Antenna Theory, Analysis and Design*, 2nd edition, John Wiley & Sons, New York, Chap. 12, pp. 575–597 (1997).

(List continued on next page.)

*Primary Examiner*—Hoang Nguyen
(74) *Attorney, Agent, or Firm*—Ladas & Parry

(57) ABSTRACT

A flexible antenna array comprises a plurality of layers of thin metal and a flexible insulating medium arranged as a sandwich of layers. Each layer of the sandwich is patterned as needed to define: (i) antenna segments patterned in one of the metal layers, (ii) an array of metallic top elements formed in a layer spaced from the the antenna segments, the array of metallic top elements being patterned in another metal layer, (iii) a metallic ground plane formed in a layer spaced from the array of metallic top elements, the metallic ground plane having been formed from still another metal layer, and (iv) inductive elements coupling each of the top elements in the array of metallic top elements with said ground plan. An array of remotely controlled switches are provided for coupling selected ones of said antenna segments together.

20 Claims, 3 Drawing Sheets

U.S. PATENT DOCUMENTS

| | | | | |
|---|---|---|---|---|
| 4,266,203 | A | 5/1981 | Saudreau et al. | 333/21 |
| 4,308,541 | A | 12/1981 | Seidel et al. | 343/786 |
| 4,387,377 | A | 6/1983 | Kandler | 343/756 |
| 4,594,595 | A | 6/1986 | Struckman | 343/770 |
| 4,737,795 | A | 4/1988 | Nagy et al. | 343/712 |
| 4,749,996 | A | 6/1988 | Tresselt | 343/700 |
| 4,760,402 | A | 7/1988 | Mizuno et al. | 343/713 |
| 4,782,346 | A | 11/1988 | Sharma | 343/795 |
| 4,821,040 | A | 4/1989 | Johnson et al. | 343/700 MS |
| 4,835,541 | A | 5/1989 | Johnson et al. | 343/713 |
| 4,843,400 | A | 6/1989 | Tsao et al. | 343/700 |
| 4,843,403 | A | 6/1989 | Lalezari et al. | 343/767 |
| 4,853,704 | A | 8/1989 | Diaz et al. | 343/767 |
| 4,905,014 | A | 2/1990 | Gonzalez et al. | 343/909 |
| 5,021,795 | A | 6/1991 | Masiulis | 343/700 |
| 5,023,623 | A | 6/1991 | Kreinheder et al. | 343/725 |
| 5,081,466 | A | 1/1992 | Bitter, Jr. | 343/767 |
| 5,115,217 | A | 5/1992 | McGrath et al. | 333/246 |
| 5,146,235 | A | 9/1992 | Frese | 343/895 |
| 5,158,611 | A | 10/1992 | Ura et al. | 106/499 |
| 5,177,493 | A | 1/1993 | Kawamura | 343/713 |
| 5,208,603 | A | 5/1993 | Yee | 343/909 |
| 5,268,701 | A | 12/1993 | Smith | 343/767 |
| 5,287,118 | A | 2/1994 | Budd | 343/909 |
| 5,402,134 | A | 3/1995 | Miller et al. | 343/742 |
| 5,519,408 | A | 5/1996 | Schnetzer | 343/767 |
| 5,525,954 | A | 6/1996 | Komazaki et al. | 333/219 |
| 5,531,018 | A | 7/1996 | Saia et al. | 29/622 |
| 5,532,709 | A | 7/1996 | Talty | 343/819 |
| 5,534,877 | A | 7/1996 | Sorbello et al. | 343/700 |
| 5,541,614 | A | 7/1996 | Lam et al. | 343/792.5 |
| 5,557,291 | A | 9/1996 | Chu et al. | 343/725 |
| 5,589,845 | A | 12/1996 | Yandrofski et al. | 343/909 |
| 5,611,940 | A | 3/1997 | Zettler | 73/514 |
| 5,638,946 | A | 6/1997 | Zavracky | 200/181 |
| 5,682,168 | A | 10/1997 | James et al. | 343/713 |
| 5,694,134 | A | 12/1997 | Barnes | 343/700 |
| 5,721,194 | A | 2/1998 | Yandrofski et al. | 505/210 |
| 5,818,394 | A | 10/1998 | Aminzadeh et al. | 343/713 |
| 5,850,198 | A | 12/1998 | Lindenmeier et al. | 343/713 |
| 5,874,915 | A | 2/1999 | Lee et al. | 342/375 |
| 5,892,485 | A | 4/1999 | Glabe et al. | 343/789 |
| 5,894,288 | A | 4/1999 | Lee et al. | 343/770 |
| 5,917,458 | A | 6/1999 | Ho et al. | 343/909 |
| 5,923,303 | A | 7/1999 | Schwengler et al. | 343/853 |
| 5,929,819 | A | 7/1999 | Grinberg | 343/754 |
| 5,945,951 | A | 8/1999 | Monte et al. | 343/700 |
| 5,949,382 | A | 9/1999 | Quan | 343/767 |
| 6,005,519 | A | 12/1999 | Burns | 343/700 |
| 6,005,521 | A | 12/1999 | Suguro et al. | 343/700 MS |
| 6,037,912 | A | 3/2000 | DeMarre | 343/815 |
| 6,040,803 | A | 3/2000 | Spall | 343/700 |
| 6,046,655 | A | 4/2000 | Cipolla | 333/137 |
| 6,054,659 | A | 4/2000 | Lee et al. | 200/181 |
| 6,075,485 | A | 6/2000 | Lilly et al. | 343/700 |
| 6,081,235 | A | 6/2000 | Romanofsky et al. | 343/700 |
| 6,081,239 | A | 6/2000 | Sabet et al. | 343/753 |
| 6,091,367 | A | 7/2000 | Kabashima et al. | 343/700 MS |
| 6,097,263 | A | 8/2000 | Mueller et al. | 333/17.1 |
| 6,097,343 | A | 8/2000 | Goetz et al. | 343/708 |
| 6,118,406 | A | 9/2000 | Josypenko | 343/700 |
| 6,118,410 | A | 9/2000 | Nagy | 343/713 |
| 6,127,908 | A | 10/2000 | Bozler et al. | 333/246 |
| 6,154,176 | A | 11/2000 | Fathy et al. | 343/700 |
| 6,166,705 | A | 12/2000 | Mast et al. | 343/853 |
| 6,175,337 | B1 | 1/2001 | Jasper, Jr. et al. | 343/770 |
| 6,191,724 | B1 | 2/2001 | McEwan | 342/21 |
| 6,208,316 | B1 | 3/2001 | Cahill | 343/909 |
| 6,218,978 | B1 | 4/2001 | Simpkin et al. | 342/5 |
| 6,246,377 | B1 | 6/2001 | Aiello et al. | 343/770 |
| 6,384,797 | B1 * | 5/2002 | Schaffner et al. | 343/795 |
| 6,417,807 | B1 | 7/2002 | Hsu et al. | 343/700 |
| 6,433,756 | B1 * | 8/2002 | Sievenpiper et al. | 343/909 |
| 6,483,481 | B1 * | 11/2002 | Sievenpiper et al. | 343/909 |

OTHER PUBLICATIONS

Balanis, C., "Microstrip Antennas," *Antenna Theory, Analysis and Design*, 2nd edition, John Wiley & Sons, New York, Chap. 14, pp. 722–736 (1997).

Perini, P. and C. Holloway, "Angle and Space Diversity Comparisons in Different Mobile Radio Environments," *IEEE Transactions on Antennas and Propagation*, vol. 46, No. 6, pp. 764–775 (Jun. 1998).

Vaughan, R., "Spaced Directive Antennas for Mobile Communications by the Fourier Transform Method," *IEEE Transactions on Antennas and Propagation*, vol. 48, No. 7, pp. 1025–1032 (Jul. 2000).

Bradley, T.W., et al., "Developmen.t of a Voltage–Variable Dielectric (VVD), Electronic Scan Antenna," *Radar 97*, Publication No. 449, pp. 383–385 (Oct. 1997).

Cognard, J., "Alignment of Nematic Liquid Crystals and Their Mixtures," *Mol. Cryst. Liq, Cryst.*, Suppl. 1, 1 (1982) pp. 1–74.

Doane, J.W., et al., "Field Controlled Light Scattering from Nematic Microdroplets," *Appl. Phys. Lett.*, vol. 48, pp. 269–271 (Jan. 1986).

Ellis, T.J. and G.M. Rebeiz, "MM–Wave Tapered Slot Antennas on Micromachined Photonic Bandgap Dielectrics," *1996 IEEE MTT–S International Microwave Symposium Digest*, vol. 2, pp. 1157–1160 (1996).

Jensen, M.A., et al., "EM Interaction of Handset Antennas and a Human in Personal Communications," *Proceedings of the IEEE*, vol. 83, No. 1, pp. 7–17 (Jan. 1995).

Jensen, M.A., et al., "Performance Analysis of Antennas for Hand–held Transceivers using FDTD," *IEEE Transactions on Antenna and Propagation*, vol. 42, No. 8, pp. 1106–1113 (Aug. 1994).

Linardou, I., et al., "Twin Vivaldi antenna fed by coplanar waveguide," *Electronics Letters*, vol. 33, No. 22, pp. 1835–1837 (Oct. 23, 1997).

Ramo, S., et al., *Fields and Waves in Communication Electronics*, 3rd edition (New York, John Wiley & Sons, 1994) Section 9.8–9.11, pp. 476–487.

Schaffner, J.H., et al., "Reconfigurable Aperture Antennas Using RF MEMS Switches for Multi–Octave Tunability and Beam Steering," IEEE, pp. 321–324 (2000).

Sievenpiper, D., et al., "Low–profile, four–sector diversity antenna on high–impedance ground plane," *Electronics Letters*, vol. 36, No. 16, pp. 1343–1345 (Aug. 3, 2000).

Sievenpiper, D. and Eli Yablonovitch, "Eliminating Surgace Currents with Metallodielectric Photonic Crystals," *1998 IEEE MTT–S International Microwave Symposium Digest*, vol. 2, pp. 663–666 (Jun. 7, 1998).

Sievenpiper, D., et. al., "High–Impedance Electromagnetic Surfaces with a Forbidden Frequency Band," *IEEE Transactions on Microwave Theory and Techniques*, vol. 47, No. 11, pp. 2059–2074 (Nov. 1999).

Sevenpiper, D., "High–Impedance Electromagnetic Surfaces," *Ph.D. Dissertation*, Dept. of Electrical Engineering, University of California, Los Angeles, CA, 1999.

Wu, S.T., et al., "High Birefringence and Wide Nematic Range Bis–tolane Liquid Crystals," *Appl. Phys. Lett.*, vol. 74, No. 5, pp. 344–346 (Jan. 1999).

* cited by examiner

A a cross-section of the thin film copper/polyimide multilayer HDMI MCMM-D integration structure fabricated upon a silicon base substrate.

HDMI DECAL is being peeled from reusable quartz carrier.

LOW-COST HDMI-D PACKAGING TECHNIQUE FOR INTEGRATING AN EFFICIENT RECONFIGURABLE ANTENNA ARRAY WITH RF MEMS SWITCHES AND A HIGH IMPEDANCE SURFACE

FIELD OF THE INVENTION

This invention relates to a low-cost packaging method which utilizes a commercially available High Density Multilayer Interconnect (HDMI or sometimes simply HDI) package and multichip interconnect for the integration of a novel 2-D reconfigurable antenna array with Radio Frequency (RF) Microelectromechanical (MEM) switches on top of a high impedance surface (High-Z Surface).

BACKGROUND OF THE INVENTION

The prior art includes U.S. Pat. No. 5,541,614 to Juan F. Lam, Gregory L. Tangonan, and Richard L. Abrams, "Smart antenna system using microelectromechanically tunable dipole antennas and photoic bandgap materials". This patent shows how to use RF MEMS switches and photonic bandgap surfaces for reconfigurable dipoles.

The prior art also includes RF MEMS tunable dipoles ¼ wavelength above a metallic ground plane, but this approach results in limited bandwidth and is not suspectible to convenient packaging.

The prior art further includes a pending application of D. Sievenpiper and E. Yablonovitch, "Circuit and Method for Eliminatig Surface Currents on Metals" U.S. provisional patent application, Ser. No. 60/079,953, filed on Mar. 30, 1998 and corresponding PCT application PCT/US99/06884, published as WO99/50929 on Oct. 7, 1999 which disclose a high impedance surface (also called a Hi-Z surface herein).

The present invention takes advantage of proven, low-cost, high-density, multichip module (HDMI MCM-D) packaging. Such packaging is commercially available from Raytheon of El Segundo, Calif. under name/model number HDMI. FIG. 1 illustrates a cross-section of a prior art thin film copper/polyimide multilayer HDMI MCM-D integrated structure fabricated on a silicon substrate. As is known in the art, the fabrication process involves spin or curtain coating of ~10-$\mu$m-thick polyimide dielectric layers and sputter deposition of ~10-$\mu$m-thick copper conductor layers in an interactive process which includes phase mask laser formation of z-axis interconnect vias and metal patterning. Using comparable processes, more than 35,000 complex 2"×4" MCM-D modules have been built and used in airborne radar, military and commercial satellites, and space projectiles to meet demanding weight and volume requirements, with no reported field failures.

The substrate for this package used in the present invention is preferably either glass, quartz or silicon (Si). A Hi-Z is also provided. The dielectric for the Hi-Z surface is a polyimide layer which may have been originally used for the packaging. The antenna is placed adjacent the Hi-Z surface, and the RF MEMS switches are used to reconfigure the antenna simply by changing the dipole's length. The feed structures for the antennas and dc lines are placed behind the Hi-Z Surface, so that they do not interfere with the radiation pattern of the antenna. The whole package is environmentally protected.

Preferably the Hi-Z surface utilized is a Hi-Z surface with added discrete inductors.

There is and has been a need for a packaged device of the type described above since it has a wide variety of applications in military and commercial communications requiring small reliable high performance antennas. One reason is that RF MEMS switches offer very low insertion loss (<0.2 dB) and high isolation (>35 dB) over a very broad frequency range from dc to 40 GHz. Furthermore, they consume very little power (i.e. less than 200 pJ per activation). The High-Z Surface allows the antenna to be very compact. Finally, since the antenna is reconfigurable by means of the RF MEM switches, it can be made to operate at different desired frequencies.

BRIEF DESCRIPTION OF THE INVENTION

In general terms, the present invention provides, in one aspect thereof, a method of making a thin, flexible antenna. According to this aspect of the invention, a layer of a flexible insulating medium is deposited on a substrate and patterning the layer of insulating medium to form openings therein. Thereafter, metal layers are deposited on a previously deposited insulating layer and patterned as needed and layers of a flexible insulating medium are deposited on the previously deposited metal layer and patterned as needed, the layers of metal and layers of insulating medium forming form a multilayered high impedance surface having an upper surface with antenna segments having been patterned from a metal layer previously deposited thereat, an array of metallic top elements formed in a layer spaced from the upper surface, the array of metallic top elements having been patterned from a metal layer previously deposited thereat, a metallic ground plane formed in a layer spaced from the array of metallic top elements, the metallic ground plane having been formed from a metal layer previously deposited thereat, and inductive elements coupling each of the top elements in the array of metallic top elements with the ground plane, the inductive elements having been formed from one or more metal layers previously deposited. Then optically controlled switches are disposed adjacent at least selected ones of the antenna segments for coupling the adjacent antenna segments together in response to light impinging a photovoltaic cell associated each optically controlled switch. Optic fibers are arranged on or adjacent the high impedance surface with distal ends of each optic fiber being coupled to a respective one of the optically controlled switches for coupling light carried by the optic fibre to the photovoltaic cells associated with the optically controlled switch. The multilayered high impedance surface from the substrate, the substrate simply providing a support for making the thin, flexible antenna during manufacture.

DETAILED DESCRIPTION

Figure 1:
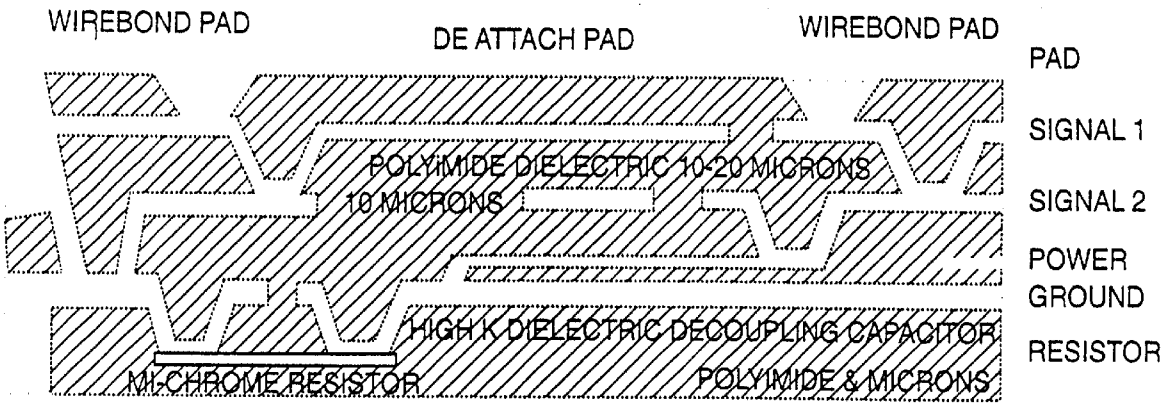
FIG. 1 is a cross sectional view through a thin film copper/polyimide multilayer HDMI MCM-D integration structure fabricated upon a silicon substrate.
Figure 2:
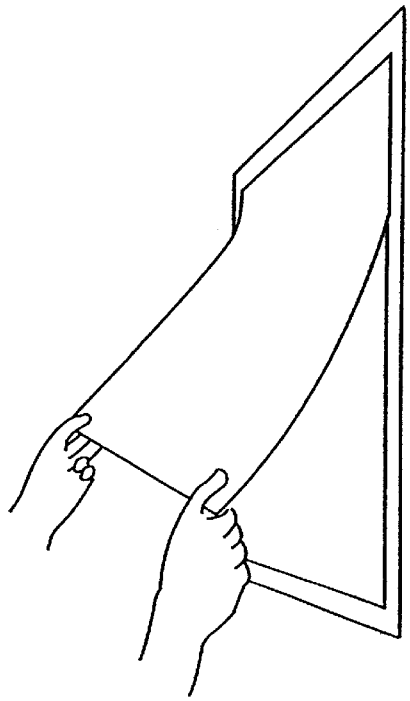
FIG. 2 depicts a HDMI decal being peeled from a reuseable quartz carrier or substrate.

These HDMI fabrication processes discussed above can be used to make thin, lightweight flexible reconfigurable antennas that can assume and therefor be placed on contoured surfaces, if desired. FIG. 2 shows a 24"×24"0.007"-thick flexible multi-layer HDMI interconnection structure being removed from the reusable carrier upon which it was fabricated.

Figure 3A:
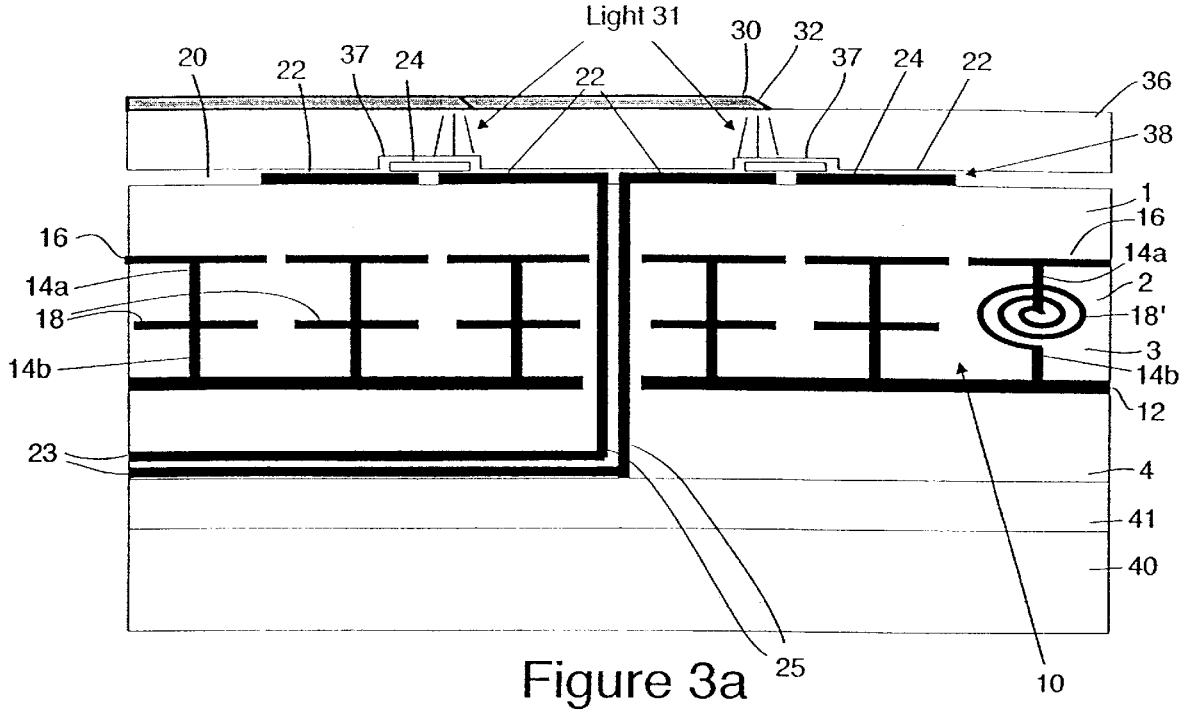
FIG. 3*a* is a cross sectional view of an HDMI reconfigurable antenna in accordance with the present invention.

FIG. 3*a* shows a cross-section the reconfigurable antenna of the present invention. The first 1, second 2, and third 3 HDMI layers are utilized to help define a Hi-Z surface 10 and preferably a Hi-Z surface with added discrete inductors 18. Plated through metallic vias form a plurality of pairs of studs 14*a*, 14*b*, each pair connecting each metallic top element 16 of Hi-Z surface formed on the third layer 3 to a ground plane 12 formed on the first layer 1. A plurality of discrete inductors 18 are optionally formed on the third layer with each inductor 28 of the plurality being arranged in series with each pair of studs 14*a*, 14*b* to increase the bandwidth of the Hi-Z surface. Since the studs 14*a*, 14*b* of the Hi-Z surface have some inherent inductance associated with them, those practicing the present invention may decide not to use discrete inductors 18, in which case layers 2 and 3 can then be combined into a single layer and the plurality of pairs of studs 14*a*, 14*b* would typically then be replaced by a plurality of single studs.

On the third layer 3, the top elements 16 are closely arranged to capacitively couple them to neighboring elements 16. As illustrated, antenna dipole segments 22 and RF MEMS switches 24 are disposed above the Hi-Z surface formed on layers 1–3. Indeed, the antenna dipole elements 22 are preferably formed on a layer 1 which overlays the Hi-Z surface formed on layers 1–3. The antenna dipole segment feed lines 23 are preferably arranged beneath the ground plane 12 on layer 4 and are connected by studs 25 formed by metal filled via holes through layers 1–4 to the dipole segments 22. The RF MEM switches 24 are preferably optically controlled. Optically controlled RF MEMS switches 24 are equipped with photovoltaic cells 16 (FIG. 4) which provide an actuation voltage for an associated cantilevered arm 28 (FIG. 4).

Figure 3B:
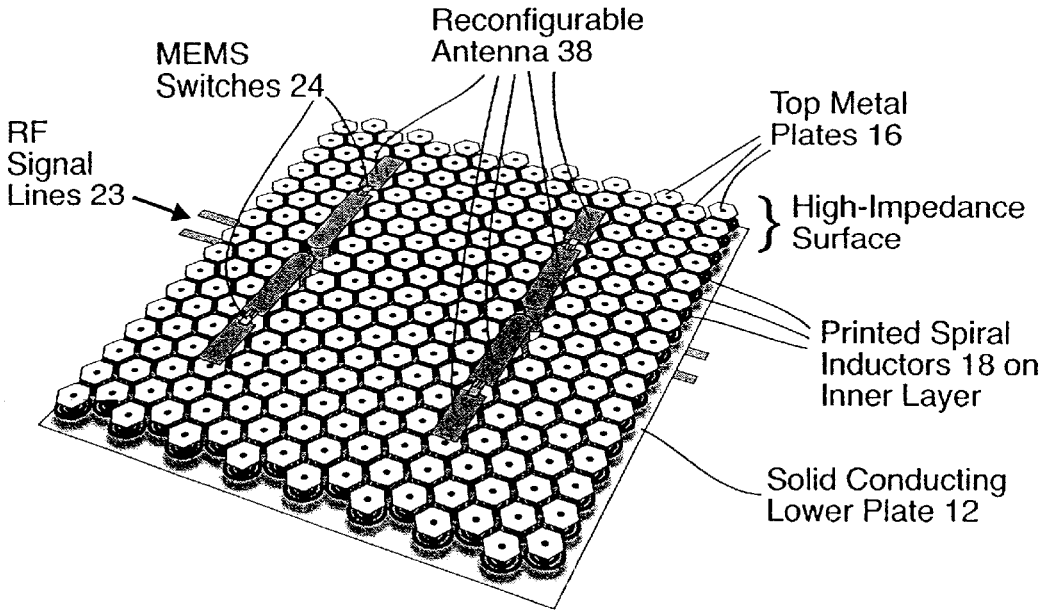
FIG. 3*b* is a perspective view of the HDMI reconfigurable antenna of FIG. 3*a*, with the polyimide layers and the dielectric top layer omitted for clarity's sake.

FIG. 3*b* is a perspective view of the HDMI reconfigurable antenna of FIG. 3*a*, with the polyimide layers 1, 2, 3, and 4 and the dielectric top layer 36 omitted for clarity's sake. In this view the top elements 16 are shown in a two dimensional array disposed over the ground plane 12. Each top element has an associated discrete inductor 18 in this embodiment. In some embodiments the discrete inductors 18 may be omitted since there may be sufficient inductive inherent in the other structures depicted. In that case, one of the mid layers 2 or 3 may also be omitted. The inductors 18 are depicted in FIG. 3*a* are preferably coil-shaped inductors. One of these coil-shaped inductors 18' is depicted as if in a perspective view in order to depict its coil shape. Since the coil-shaped inductors 18 would normally occur on a single layer of the HDMI structure, the coil shaped inductors 18 in this cross section view of FIG. 3*a* would normally appear as a simple line (as they are so depicted for five of the six inductors 18 in this view). The top elements 16 are depicted as being hexagonal in plan view (see FIG. 3*b*). The top elements can be of any convenient shape, including circular, square, rectangular, rectilinear, etc. The feed line conductors 23 are depicted over each other in FIG. 3*a*, but the number of layers needed for the HDMI structure can possibly be reduced by disposing these conductors adjacent to each other instead.

Figure 4:
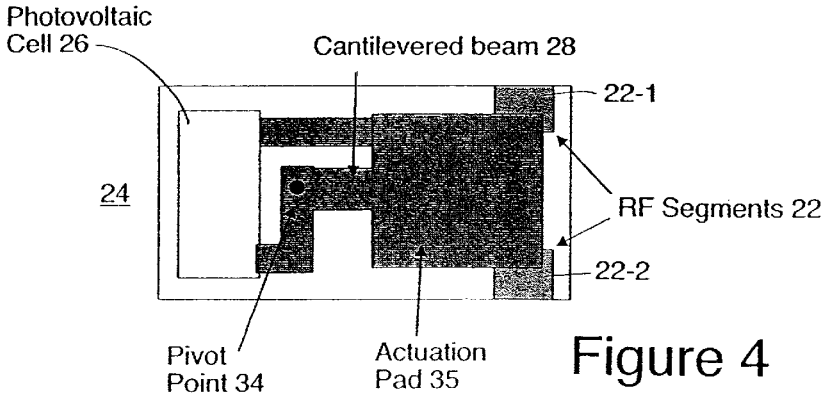
FIG. 4 is a top view of an optically controlled MEMS switch.

FIG. 4 is a top view of an optically controlled MEM switch 24. The switch 24 has a photovoltaic cell 26, a cantilevered arm or beam 28 which is connected at one end to a pivot point 34 and has at its other end a contact or actuation pad 35 which is pulled into contact with two dipole segments, here identified as 22-1 and 22-2. Typically a number of dipole segments 22 are arranged axially of each other and the effective length of a dipole antenna 38 formed thereby is controlled by controlling the number of segments 22 connected together by closing appropriate ones of the switches 24.

It is to be appreciated that typically a large number of parallel dipole antennas, with associated feeds 23, 25, would preferably be disposed in the structure of FIGS. 3*a* and 3*b*. Moreover, each arm of a dipole antenna would comprise a number of segments 22 and controlling the number of segments which are connected at a given time controls the frequency at which each dipole antenna 38 is resonant. In FIGS. 3*a* and 3*b* each arm of the dipole antenna 38 is shown with two segments 22 solely for ease of representation, it being understood that typically each arm would comprise many such segments 22 and associated switches 24 and moreover that the segments 22 may have different lengths. By appropriately controlling which switches 24 are closed, the resonant frequency of the associated dipole 38 is similarly controlled.

For a frequency of interest, the length of a arm of a dipole is typically equal to ¼ its wavelength while the size of each top element 16 is typically about 1/10 its wavelength. The size of the top element is its diameter (if circular viewed from the top) or the length of one of its side (if square viewed from the top) or a similar measurement of size it the top element assumes some other shape than square or circular. Indeed, the preferred shape of a top element 16 is hexagonal when viewed from the top.

This HDMI packaging approach enables effective integration of reconfigurable antenna, high impedance surface, and RF MEMS switch technologies as a compact ultra-lightweight antenna. The mass of commercially available seven-conductor-layer HDMI interconnection decals is approximately 506 grams/$m^2$, so individual antenna can be both small and light weight.

Making the Hi-Z HDMI devices disclosed herein involves providing layers 1, 2, 3, 4 of polyimide and layers of metal which are deposited sequentially. In FIG. 3*a* conductors 23 are shown immediately adjacent a release layer 41 supported by support surface 40 and thus they would be deposited first on the release layer 41. The use of a release layer 41 is optional. The release layer 41 facilitates removed of the fabricated Hi-Z HDMI devices from the support surface 40 used to support the device during manufacture. The support surface 40 may be a quartz substrate, particularly if the Hi-Z HDMI devices are to be removed therefrom after fabrication. Alternatively, the support surface may be a substrate 40 which becomes a part of the finished Hi-Z HDMI device if no release layer 41 is used.

The first layer of polyimide 4 is deposited preferably as a liquid film which can be as thin as a few microns or even thinner. The polyimide is typically thermally hardened, after which it is patterned, for example by scanning across it with a laser beam through a phase mask. The phase mask is disposed in front of the surface and it determines the pattern which is left by the laser beam. The exposed parts of the polyimide are removed with an appropriate solvent. Holes are thus formed in the polyimide and those holes define where conductive vias will occur in the layer of polyimide to form the vertically arranged feed wires and studs 14*a*, 14*b*, 25. Metal is then deposited by evaporation or by electroplating it, filling the holes in the polyimide to form metal metal vias therein. Each metal layer is patterned, as needed, to define either the ground plane 12, the inductors 18 or the top elements 16 using suitable a suitable etchant.

After patterning, an etched metal layer is typically covered by another layer of polyimide which is exposed and patterned in the same way as the prior layer, with suitable locations for the vias being defined therein and followed by another metal layer which is patterned as needed. This process is repeated building up multiple layers of etched polyimide and etched metal until a major portion of the structure depicted in FIG. 3*a* is arrived at. Thereafter, the MEM switches 24 are installed to selectively connect segments 22. The MEM switches 24 are preferably attached with a suitable adhesive, such as epoxy, and then their contacts are wire-bonded to the antenna segments 22.

In the embodiment of FIG. 3*a*, the RF MEM switches 24 are preferably optically triggered. Optically triggered MEM switches, such as the MEM switch 24 depicted by FIG. 4, include an integral photovoltaic cell 26 which generates a voltage in response to light, the voltage being effective to close the switch. In FIG. 4, the MEM switch includes an actuation pad 35 disposed at the end of switch's cantilevered beam 28 which pad 35 is effective to couple the two RF lines 22-1 and 22-2 to each order in response to light impinging on the photovoltaic cell 26. Optically controlled MEM switches are further disclosed in U.S. patent application Ser. No. 09/429,234 filed Oct. 29, 1999 and entitled "Optically Controlled MEM Switch" which is assigned to the assignee of the present application. Optically controlled MEM switches can be coupled to optic fibers 30 (see FIG. 3*a*) using the techniques disclosed in U.S. patent application Ser. No. 09/648,689 filed Aug. 25, 2000 entitled "Optical Bond Wire Interconnections" which application is assigned to the assignee of the present application, by which inclined mirrored surfaces are formed to direct light from a wave guide or an optical fiber 30 into an optically controlled MEM switch 24. The disclosures of U.S. patent application Ser. No. 09/429,234 filed Oct. 29, 1999 entitled "Optically Controlled MEM" and U.S. patent application Ser. No. 09/648,689 filed Aug. 25, 2000 entitled "Optical Bond Wire Interconnections" are hereby incorporated herein by this reference.

This HDMI packaging approach can be used to form optical channels within the HDMI polyimide to provide for the optical actuation of optically activated RF MEMS switches and/or photonic distribution of signals. Thus, when optically triggered RF MEM switches are used, the present invention allows for the direct optical mixing of microwave RF signals at the antenna elements.

Instead of using inclined mirrored surfaces of the type disclosed in the aforementioned U.S. patent application Ser. No. 09/648,689 filed Aug. 25, 2000 entitled "Optical Bond-Wire Interconnections", prisms may be disposed above each optically triggered MEM switch 24 to couple light from an optical wave guide, such as one of the aforementioned optical fibers 30, into an associated optically controlled MEM switch 24. In any case, both the prism and the inclined mirrored surface provide a reflecting surface 32 for directing the light 31 carried by a wave guide or an optical fiber 30 in a direction essentially orthogonal to the major axis of the wave guide or optical fiber 30.

The optical signals can be routed to the optically activated MEM switches using planar optical wave guides, which can be printed on a dielectric substrate 36. See the co-pending U.S. patent application Ser. No. 09/648,689 filed Aug. 1, 2000 entitled "A Reconfigurable Antenna for Multiple Band, Beam-Switching Operation" the disclosure of which is hereby incorporated herein by reference. Such wave guides 30 would typically consist of linear channels of material having a higher index of refraction provided on a substrate 36 having a lower index of refraction. This structure, when placed over the optically activated MEM switches, would radiate light in a downward direction to the optically activated MEM switches through small prisms or inclined mirrored surfaces 32, as shown by FIG. 3*a*. If prisms are used, they can be formed as molded or ground shapes disposed on glass or other optically transparent material. The substrate 36 can be glass of a lower refractive index. One material which may prove satisfactory for substrate 36 is a flexible material sold under the tradename Silastic which is a silicone-like material manufactured by Corning Glass.

A corresponding reflecting surface 32 is disposed above each optically triggered MEM switch 24 to couple the light from a wave guide/optical fiber 30 into the photovoltaic cell 28 associated therewith. The dipole segments are typically longer than an individual cell of the high-impedance surface which is defined size-wise by a top element 16. The number of MEM switches utilized with depend on the capabilities of the antenna. For simply switching frequencies, only a few MEM switches 24 would be needed—typically two for each frequency band needed for each dipole 38. For phase tuning, many switches 24 would be typically utilized-two for each phase state needed for each dipole 38.

The dielectric substrate 36 is preferably patterned or formed having cavities 37 formed therein to accommodate the MEM switches 22 and to help align the reflecting surfaces 32 at the ends of the fibre optic cables 30 with the MEM switches 22. The final package is then preferably hermetically sealed in an air-tight package which is preferably filled with an inert gas 20 such as nitrogen, argon or sulfur hexafluroide.

HDMI processing is well known in the art of multilayer electronic packaging and therefore the details of the HDMI processing are not spelled out here. Raytheon in Dallas, Tex. is well known in the in this field.

Having described the invention in connection with certain embodiments thereof, modification will now certainly suggest itself to those skilled in the art. As such, the invention is not to be limited to the disclosed embodiments except as required by the appended claims.

What is claimed is:

1. A method of making a thin, flexible antenna comprising the steps of:

(a) depositing a layer of a flexible insulating medium on a release layer or substrate and patterning the layer of insulating medium to form openings therein;

(b) depositing a metal layer on the previously deposited insulating layer, as patterned, and pattering the metal layer as needed;

(c) depositing a layer of a flexible insulating medium on the previously deposited metal layer, as patterned, and patterning the layer of insulating medium to form openings therein;

(d) repeating steps (b) and (c) as needed to form a multilayered high impedance surface having an upper surface with antenna segments having been patterned from a metal layer previously deposited thereat in accordance with step (b), an array of metallic top elements formed in a layer spaced from the upper surface, the array of metallic top elements having been patterned from a metal layer previously deposited thereat in accordance with step (b), a metallic ground plane formed in a layer spaced from the array of metallic top elements, the metallic ground plane having been formed from a metal layer previously deposited thereat in accordance with step (b);

(e) placing optically controlled switches adjacent at least selected ones of said antenna segments for coupling the adjacent antenna segments together in response to light impinging a photovoltaic cell associated each optically controlled switch; and (f) disposing optic wave guides or fibers on or adjacent said high impedance surface with distal ends of each optic wave guide or fiber being coupled to a respective one of said optically controlled switches for coupling light carried by the optic wave guide or fibre to the photovoltaic cells associated with the optically controlled switch.

2. The method of claim 1 wherein the optically controlled switches are MEM switches.

3. The method of claim 1 wherein, in step (d), inductive elements are provided coupling each of the top elements in the array of metallic top elements with said ground plane, the inductive elements being formed from one or more metal layers previously deposited in accordance with step (b).

4. The method of claim 3 wherein, in step (d), the inductive elements include discrete inductors are formed in series with studs connecting the array of top elements with said ground plane, the discrete inductors being formed on a layer of insulating medium.

5. The method of claim 1 wherein the optic wave guides or fibers are disposed on or in a substrate having a lower index of refraction than an index of refraction associated with the wave guides or fibers.

6. The method of claim 1 wherein the insulating medium is polyimide.

7. A method of making an antenna comprising the steps of:

(a) patterning a layer of insulating medium to form openings therein;

(b) depositing a metal layer on the previously deposited insulating layer, as patterned, and pattering the metal layer as needed;

(c) depositing a layer of insulating medium on the previously deposited metal layer, as patterned, and patterning the layer of insulating medium to form openings therein;

(d) repeating steps (b) and (c) as needed to form a multilayered high impedance surface having an upper surface with antenna segments having been patterned from a metal layer previously deposited thereat in accordance with step (b), an array of metallic top elements formed in a layer spaced from the upper surface, the array of metallic top elements having been patterned from a metal layer previously deposited thereat in accordance with step (b), a metallic ground plane formed in a layer spaced from the array of metallic top elements, the metallic ground plane having been formed from a metal layer previously deposited thereat in accordance with step (b);

(e) placing remotely controlled switches adjacent at least selected ones of said antenna segments for coupling the adjacent antenna segments together in response to an actuating signal associated with each remotely controlled switch; and (f) disposing actuating signal channels in or adjacent said high impedance surface with distal ends of each channel being operatively associated with a respective one of said remotely controlled switches for coupling the actuating signal carried thereby to the associated remotely controlled switch.

8. The method of claim 7 wherein the remotely controlled switches are MEM switches.

9. The method of claim 8 wherein the remotely controlled switches are optically controlled MEM switches.

10. The method of claim 9 wherein the channels are defined by optic wave guides or fibers disposed on or in a substrate.

11. The method of claim 7 wherein, in step (d), inductive elements are provided coupling each of the top elements in the array of metallic top elements with said ground plane, the inductive elements being formed from one or more metal layers previously deposited in accordance with step (b).

12. The method of claim 11 wherein, in step (d), the inductive elements include discrete inductors are formed in series with studs connecting the array of top elements with said ground plane, the discrete inductors being formed on a layer of insulating medium.

13. A flexible antenna array comprising:

(a) a plurality of layers of thin metal and layers of a flexible insulating medium arranged as a sandwich of layers, each layer of the sandwich being patterned as needed to define:

(i) antenna segments patterned in one of the metal layers, (ii) an array of metallic top elements formed in a layer spaced from the the antenna segments, the array of metallic top elements being patterned in another metal layer, and (iii) a metallic ground plane formed in a layer spaced from the array of metallic top elements, the metallic ground plane having been formed from still another metal layer; and (b) an array of remotely controlled switches for coupling selected ones of said antenna segments together.

14. The array of claim 13 wherein the switches are optically controlled MEMs switches.

15. The array of claim 14 further including a dielectric layer supporting optic fibres, the dielectric layer being disposed adjacent the MEMs switches and the optic fibres having associated reflecting surfaces for reflecting light carried by the optic fibers or wave guides onto light sensitive surface associates with said optically controlled MEMs switches.

16. The array of claim 15 wherein the dielectric layer has a plurality of cavities formed therein for accommodating said MEM switches when the dielectric layer being disposed adjacent the MEMs switches.

17. The array of claim 15 wherein the optic wave guides or fibers are disposed on or in the dielectric layer and wherein the dielectric layer has a lower index of refraction than an index of refraction associated with the wave guides or fibers.

18. The array of claim 13 wherein the layers of a flexible insulating medium are layers of polyimide.

19. The array of claim 13 wherein at least one of said plurality of layers of thin metal is patterned to define:

(iv) inductive elements coupling each of the top elements in the array of metallic top elements with said ground plane.

20. The array of claim 19 wherein the inductors are spiral inductors disposed between two layers of flexible insulating medium.

* * * * *